US007610771B2

(12) United States Patent
Rothmann et al.

(10) Patent No.: US 7,610,771 B2
(45) Date of Patent: Nov. 3, 2009

(54) REFRIGERATING APPARATUS AND REFRIGERATOR

(75) Inventors: Carsten Rothmann, Krusaa (DK); Ole Schebel Bachmann, Soenderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 417 days.

(21) Appl. No.: 11/035,293

(22) Filed: Jan. 13, 2005

(65) Prior Publication Data

US 2005/0166625 A1 Aug. 4, 2005

(30) Foreign Application Priority Data

Jan. 15, 2004 (DE) ..... 10 2004 002 131

(51) Int. Cl.
*F25D 19/00* (2006.01)

(52) U.S. Cl. ..... 62/298; 62/299; 398/82

(58) Field of Classification Search ..... 62/298, 62/299, 264, 124, 126, 127, 125, 211, 440; 439/660, 27, 138, 638; 398/82; 359/127; 385/92

See application file for complete search history.

(56) References Cited

U.S. PATENT DOCUMENTS 1,885,139 A * 11/1932 Porter ..... 62/342
2,273,343 A * 2/1942 Bigelow ..... 62/151
2,522,623 A * 9/1950 Kas et al. ..... 62/297
2,988,432 A * 6/1961 Long ..... 422/122
3,174,048 A * 3/1965 Snyder et al. ..... 307/10.1
3,177,671 A * 4/1965 Stambaugh ..... 62/3.6
3,232,063 A * 2/1966 Eichhorn et al. ..... 62/3.6
3,912,162 A * 10/1975 Bauer et al. ..... 236/11
3,937,847 A * 2/1976 Elkins et al. ..... 426/231
3,949,902 A * 4/1976 Thompson ..... 222/129.1
4,224,805 A 9/1980 Rothwell
4,404,813 A * 9/1983 Paddock et al. ..... 62/127
4,543,800 A * 10/1985 Mawby et al. ..... 62/339
4,807,086 A * 2/1989 Chambliss ..... 361/212
4,966,004 A * 10/1990 Midlang et al. ..... 62/77
5,501,076 A * 3/1996 Sharp et al. ..... 62/3.6
5,574,610 A * 11/1996 Tachick et al. ..... 361/56
5,797,445 A * 8/1998 Westbrooks et al. ..... 165/11.1
6,101,819 A * 8/2000 Onaka et al. ..... 62/125
6,266,969 B1 * 7/2001 Malnati et al. ..... 62/275
6,564,574 B1 5/2003 Pereira et al.
6,675,590 B2 1/2004 Aarestrup

FOREIGN PATENT DOCUMENTS

DE 31 41 736 A1 5/1983
DE 259 547 A3 8/1988
DE 42 26 966 A1 2/1994
GB 2107905 A * 5/1983
GB 2 385 117 A 8/2003
WO WO 91/15719 A2 * 10/1991

* cited by examiner

*Primary Examiner*—Mohammad M Ali
(74) *Attorney, Agent, or Firm*—McCormick, Paulding & Huber LLP

(57) ABSTRACT

A refrigerating apparatus for a refrigerator has an electrical voltage supply and an electrical interface for connection with components of the refrigerator with the interface having a galvanic isolation between an input arrangement connected with the refrigerating apparatus and an output arrangement connected with at least one component of the refrigerator.

14 Claims, 1 Drawing Sheet

REFRIGERATING APPARATUS AND REFRIGERATOR

CROSS-REFERENCE TO RELATED APPLICATION:

Applicants hereby claim foreign priority benefits under U.S.C. § 119 from German Patent Application No. 10 2004 002 131.7, filed on Jan. 15, 2004, the content of which is incorporated by reference herein.

FIELD OF THE INVENTION

The invention concerns a refrigerating apparatus for a refrigerator and a refrigerator.

The term "refrigerator" as used here is intended to include refrigerating and freezer cabinets or chests. In the following description a refrigerating cabinet is used as an example of a refrigerator. However, the invention is also applicable to freezer cabinets and chests.

BACKGROUND OF THE INVENTION

A conventional refrigerating cabinet comprises a refrigerating circuit in which are arranged a compressor, a condenser, an expansion valve and an evaporator. During manufacture of a refrigerating cabinet these individual parts must be built into the housing of the refrigerating cabinet and must be connected with one another. Such a manufacturing process is expensive.

In U.S. Pat. No. 6,564,574 B1 it has been proposed to combine several of these elements into a refrigerating apparatus that can, for example, be pre-assembled in a factory. This refrigerating apparatus is then transported to the manufacturer of the refrigerator and there installed in the refrigerator as a single unit. This known method has, for example, the advantage that the refrigerating apparatus can be hermetically sealed at the factory and is therefore ready for immediate installation.

Such a refrigerating apparatus normally requires a supply voltage. This supply voltage corresponds to the prevailing commercially available mains voltage, which in Europe is an alternating voltage of 220 to 240 V. Refrigerators contain many other electricity-consuming devices, for example lights or an electronic control unit. These electricity-consuming devices must likewise be connected with the refrigerating apparatus. Long cable conductors are at least in part required to enable these connections.

SUMMARY OF THE INVENTION

The object of the invention is to simplify the construction of a refrigerator.

This object is achieved by a refrigerating apparatus for a refrigerator, which refrigerating apparatus has an electrical voltage supply and an electrical interface for connection with the components of the refrigerator, with the interface having a galvanic isolation between an input arrangement connected with the refrigerating apparatus and an output arrangement connected with at least one component of the refrigerator.

This solution does not lead to any shortening of the cable conductors. However, one has greater freedom in the routing of the cable conductors since the galvanic isolation means that there is no longer any direct electrical contact with the mains supply. Accordingly the requirements pertaining to mandatory electrical safety requirements are reduced.

Preferably the interface includes a transformer. A transformer reduces the voltage present at the output arrangement of the interface. Accordingly, the mandatory protective measures in refrigerators can be designed for a reduced voltage. For example one can maintain a smaller safety spacing or thinner, and therefore less expensive, insulation in the refrigerator.

Specifically, it is much preferred that the transformer produces a voltage at the output arrangement which at maximum corresponds to a protective low voltage. For example, this can be about 24 V, 12 V or 5 V alternating voltage. It can also, by means of a rectifier and smoothing circuit following the transformer, be a constant voltage in the range of 48 V, 24 V, 12 V, or 5 V. In all cases the voltage is then so small that even in the case of faulty insulation no danger exists for humans who come into contact with voltage carrying parts.

It is also advantageous if the interface includes an optical coupler. An optical coupler is for example advantageous if control signals only are to be transmitted through the interface.

In a preferred embodiment the refrigerating apparatus is formed as a functional unit, which unit includes a compressor, a condenser and an expansion valve. The refrigerating apparatus thereby contains almost all of the constructional or functional elements required for a refrigerating circuit.

In this embodiment it is of advantage if the refrigerating apparatus also includes an electronic control unit. The electronic control unit can for example control the voltage supply of the compressor. For example, the electronic control unit can regulate the speed of the compressor. It is also possible to enable temperature regulation by having the electronic control unit control the expansion valve.

In an advantageous way the refrigerating apparatus also includes an evaporator. In this embodiment the refrigerant fluid is contained in a closed circuit.

Additionally the refrigerating apparatus in a preferred embodiment can also have a heating element. Such a heating element can then be used for thawing the refrigerator.

Preferably the refrigerating apparatus has a gas sensor. A gas sensor is able to detect leakages in the refrigerant fluid circuit at an early time and to notify the user of the apparatus. If such a gas sensor is mounted within the refrigerating apparatus then there is only a short distances between the parts from which a gas loss can occur and the gas sensor.

Preferably the output arrangement of the interface includes one part of a plug connector. In this case the connection of the refrigerating apparatus with the refrigerator is especially simple. After the mechanical assembly or during the assembly a plug connection to the electricity-consuming devices or components of the refrigerator can be made simply by inserting a plug into the part of the plug connector of the output arrangement.

Preferably the output arrangement of the interface includes power transmitting terminals and/or signal transmitting terminals. In both cases the galvanic isolation is of advantage.

It is also of advantage if the output arrangement comprises a light guide. In this case, depending on circumstances, one can forego having a separate lighting means in the interior of the refrigerator. This has the special benefit that the illumination of the interior of the refrigerator is achieved without any heating of the cooling space.

The object is achieved by a refrigerator with a refrigerating section and a refrigerating apparatus, which refrigerating apparatus is galvanically separated from the refrigerating section.

Such a refrigerator requires less stringent electrical protective measures.

Preferably a human-machine interface is connected with the refrigerating apparatus, which interface is galvanically separated from the refrigerating apparatus. A human-machine interface, which is also known as a "man-machine-interface" and is abbreviated as MMI, is typically installed in the upper part of the refrigerator and contains an indicator for temperature and status. This allows the user to influence the refrigerator whereby, for example, the desired temperature for the interior of the refrigerator can be pre-set. Thereby, since one has provided a galvanic isolation between the supply voltage and the MMI, an increased personal safety is achieved for the user.

It is of advantage if the refrigerator includes one part, and the refrigerating apparatus another part, of a plug connector, which parts upon the installation of the refrigerating apparatus in the refrigerator come together in mating relationship. This design simplifies the assembly. With the insertion or pushing of the refrigerating apparatus into the refrigerator the necessary plug connection is made so that the electrical and electronic components and the electricity-consuming devices in the refrigerator are immediately supplied with the necessary electrical energy, and also their signals can be reported back to the refrigerating apparatus.

BRIEF DESCRIPTION OF THE DRAWINGS

The invention is described in the following by way of a preferred exemplary embodiment with reference to the drawings. The drawings are.

DETAILED DESCRIPTION OF THE PREFERRED EMBODIMENTS

Figure 1:
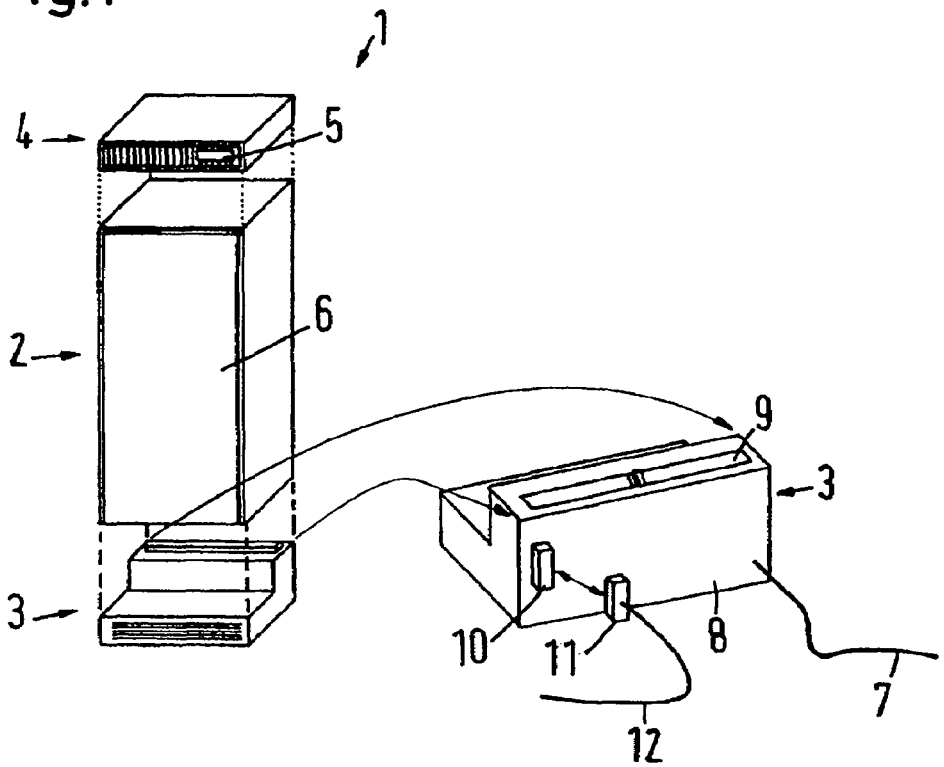
FIG. 1 is a schematic external view of a refrigerator.

A refrigerator 1, which in FIG. 1 is illustrated in schematic exploded form, includes a refrigeration section 2, a refrigeration apparatus 3 and a human-machine interface 4, which can also be referred to as a "control unit". The human-machine interface 4, as illustrated only schematically, includes an indicator 5 which indicates the temperature and/or the operating condition of the refrigeration section 2. In a way not illustrated in further detail, an adjustment element can be arranged on the human-machine interface 4 for adjustment of the desired temperature or the like.

The refrigeration section 2 includes a door 6 behind which is located a refrigerating space in which a low temperature prevails. This low temperature is created by the refrigerating apparatus 3. The refrigerating apparatus 3 is arranged at the bottom of the refrigerating section 2. In FIG. 1 it is illustrated in enlarged scale next to the refrigerator 1. In this case it is turned about 120° about its vertical axis, in order to show further details.

The refrigerating apparatus 3 includes an electrical supply conductor 7 for the voltage supply. The supply conductor is for example plugged into a normal socket providing a voltage of from 220 to 240 V. The refrigerating apparatus 3 includes a housing 8 having an L-shape. An opening 9 through which the cold air can be blow into the refrigerating section 2 is formed at the upper side of the vertically standing leg of the L. On the rear side of the housing 10 is arranged a plug 10 or a plug socket, which is described in more detail below. A second part 11 of a plug connector can be utilized together with the plug 10, which part 11 is located on an end of a conductor 12. The conductor 12 connects the refrigerating apparatus 3, for example, with the human-machine interface 4 or with other components in the refrigeration section 2. Among these components there can be a lighting means which lights the inner space upon the opening of the door 6. Other components also be a heating element needed for thawing the refrigeration section 2. It could also be a temperature sensor by means of which the refrigerating apparatus is controlled. It could also be a fan by which means the air is circulated in the interior of the refrigeration section 2.

Figure 2:
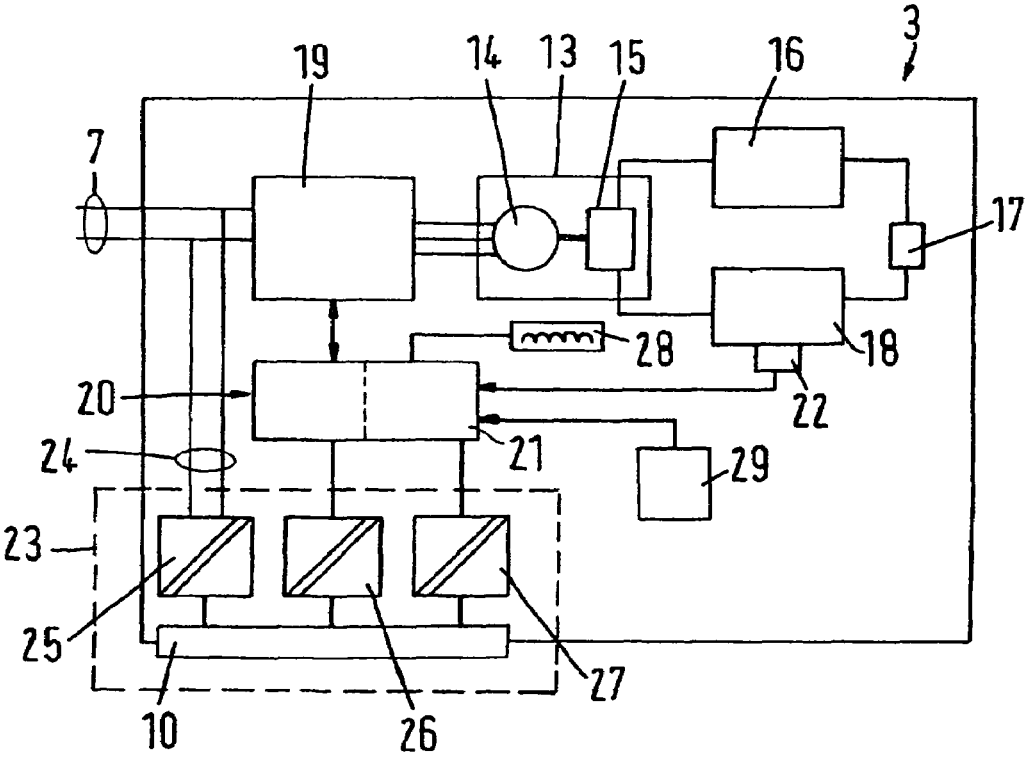
FIG. 2 is a diagrammatic view of a refrigeration apparatus.

FIG. 2 shows, in schematic form, a diagram of the inner construction of the refrigerating apparatus 3.

The refrigerating apparatus 3 includes a compressor 13 with a motor 14 and a compressing unit 15. The compressing unit 15 can for example be a reciprocating piston compressor.

The compressing unit 15 is connected with a condenser 16 which is connected with an evaporator 18 through an expansion valve 17. The evaporator 18 in turn is further connected with the compressing unit 15 so that the compressor unit 15, the condenser 16, the expansion valve 17 and the evaporator 18 form a closed refrigerant fluid circuit.

In the current embodiment the evaporator is arranged within the refrigerating apparatus 3. This is however not a requirement. One can also arrange the evaporator outside of the refrigerating apparatus 3. In this case a tubular connection would run through the opening 9 for the purpose of connecting the evaporator 18 with the refrigerating medium circuit.

The motor 14 is controlled by a motor control 19 which draws its energy from the supply conductor 7. The motor control controls for example the frequency and/or the amplitude of a three-phase supply voltage for the motor 14. The motor control 19 is here shown as a converter which is controlled by a control unit 20. The control unit 20 has a temperature control 21 with which a temperature sensor 22 is connected and which sensor senses a temperature at the condenser 18.

As mentioned above, the refrigeration section 2 includes electricity-consuming devices and other electrical components, which likewise require an electrical supply voltage and which on the other hand could also report signals to the control unit 20 or exchange information with the control unit 20. For example the current temperature should be indicated at the human-machine interface 4. To enable this it is necessary that there is a connection to the human-machine interface.

To make this possible safely, the refrigerating apparatus 3 includes an interface 23 which includes the plug 10, which in principle forms the output arrangement of the interface 23.

The interface 23 includes an input arrangement which is provided by a branch conductor 24 from the supply conductor 7. The branch conductor 24 is connected with the plug through a galvanic isolator 25 which in this case is formed by a transformer, for example a circular core transformer. The galvanic isolator 25 not only galvanically separates the branch conductor 24 from the plug 10. It also lowers the voltage coming from the supply conductor 7 to, for example, 24 V, 12 V, or 5 V alternating voltage, or, if the galvanic isolator 25, in a form not illustrated here, also includes a rectifier and a smoothing circuit, to 48 V. 24 V, 12 V, or 5 V direct current. Accordingly only a low voltage which is safe for humans appears at the plug 10 even if faulty or damaged electrical insulation is accidentally present. That is, a high voltage is no longer routed through the refrigerator but only a low voltage, in particular a low safe voltage. Accordingly the strength of the current is also limited. That is to say, no large current is now carried through the refrigerator. The interface 23 forms a galvanic isolation between the refrigerating apparatus 3 and the refrigerator 2. Through this interface 23, electrical energy is supplied to, amongst others, lighting means, heating wires for the thawing process, door contacts, blowers and other units.

The interface 23 further comprises a galvanic isolator 26, which for example can be formed by an optical coupler. One such galvanic isolator 26 is used for signal transmission, for example for a temperature sensor arranged in the interior of the refrigerator 2 or, as in the case above, for the transmission of information to the human-machine interface.

Finally a third galvanic isolator 27 is provided which at its output side emits no electrical energy, but instead gives off energy in the form of light. If one connects a light guide to this galvanic isolator 27, then one can illuminate the inner space of the refrigerator 2 with the help of such a light guide if the door 6 is opened. The illumination does not therefore cause a rise in temperature. Light guides can be made of light conducting plastic material.

The interface 23 can also include, in a way not illustrated in further detail, a digital communication bus, for example, an RS485 or a CAN-Bus. For the human-machine interface 4 this means, for example, that it does not require any of its own supply electronics.

The entire refrigerating apparatus 3 can be finished by the manufacturer and delivered to the manufacturer of the refrigerator 1. The manufacturer of the refrigerator therefore need only build the refrigerating apparatus 3 into the refrigerator 1. It can therefore be readily understood that it is with the act of installing the refrigerating apparatus that the plug 10 comes into contact with the plug connector 11 or vice-versa. Naturally it is also possible that before or after the resulting installation of the refrigerating apparatus 3 the connection between the plug 10 and the plug connector 11 is made.

After the refrigerating apparatus 3 is installed, cold air will be expelled through the opening 9 and move into the interior of the refrigeration section 2. In the case of a thawing procedure heating wires arranged in the interior of the refrigeration section 2 can be heated. One such heating element 28 consumes typically 300 W, the power for which can also be transmitted through the interface 23, the galvanic isolation ensuring that it is free from high voltage.

The opening 9 can be divided into two openings, for example one opening in the front and one opening in the rear. The evaporator 18 can also be mounted within the vertical leg of the L-shaped housing 8, separating it from the condenser 16, and possibly at a right angle to the condenser 16, should the condenser 16 be mounted in the horizontal leg of the L. In this way the evaporator 18 is located at the rear of the cooling space.

Finally, a gas sensor 29 can be arranged in the refrigerating apparatus, which sensor responds to the gas contained in the refrigerant fluid circuit. If the refrigerating apparatus 3 works, for example, with $CO_2$ as the refrigerant fluid, then the gas sensor 29 provides a warning if the $CO_2$-content in the refrigerating apparatus greatly.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A refrigerating apparatus for a refrigerator comprising:

an electrical voltage supply input arrangement; and an electrical interface for connection of refrigerating apparatus with components of the refrigerator, wherein the interface has a galvanic isolation between the input arrangement and an output arrangement connected with at least one of said components of the refrigerator, the output arrangement, including an electrical connector, configured to be mechanically releasably connected to said at least one component of the refrigerator.

2. The refrigerating apparatus according to claim 1, wherein the interface includes a transformer.

3. The refrigerating apparatus according to claim 2, wherein the transformer provides a voltage at the output arrangement which at maximum corresponds to a protective low voltage.

4. The refrigerating apparatus according to claim 1, wherein the interface has an optical coupler.

5. The refrigerating apparatus according to claim 1, wherein it is constructed as a functional unit which unit includes a compressor, a condenser and an expansion valve.

6. The refrigerating apparatus according to claim 5, wherein it includes an electronic control unit.

7. The refrigerating apparatus according to claim 5, wherein it includes an evaporator.

8. The cooling apparatus according to claim 5, wherein it includes a heating element.

9. The cooling apparatus according to claim 1, wherein it includes a gas sensor.

10. The refrigerating apparatus according claim 1, wherein the output arrangement of the interface has a part of a plug connector.

11. The refrigerating apparatus according to claim 1, wherein the output arrangement of the interface has power transmitting terminals and/or signal transmitting terminals.

12. The refrigerating apparatus according to claim 1, wherein the output arrangement has a light emitter.

13. The refrigerating apparatus according to claim 1, wherein the refrigerating apparatus is detachable.

14. The refrigerating apparatus according to claim 1, wherein the refrigerating apparatus is housed in a separate housing from the refrigerating section.

* * * * *